US006051796A

United States Patent [19]

Kuhl et al.

[11] Patent Number: 6,051,796

[45] Date of Patent: Apr. 18, 2000

[54] ELECTRIC INSULATOR MADE FROM SILICONE RUBBER FOR HIGH-VOLTAGE APPLICATIONS

[75] Inventors: Martin Kuhl, Selb; Peter Besold, Waldershof; René Mainardis, Selb, all of Germany

[73] Assignee: Ceramtec AG Innovative Ceramic Engineering, Plochingen, Germany

[21] Appl. No.: 08/776,517

[22] PCT Filed: Jul. 7, 1995

[86] PCT No.: PCT/EP95/02699

§ 371 Date: Jan. 29, 1997

§ 102(e) Date: Jan. 29, 1997

[87] PCT Pub. No.: WO96/04667

PCT Pub. Date: Feb. 15, 1996

[30] Foreign Application Priority Data

Jul. 29, 1994 [DE] Germany ..... 44 26 927

[51] Int. Cl.[7] ..... H01B 17/00; H01B 17/06; H01B 17/20

[52] U.S. Cl. ..... 174/179; 174/177; 174/178; 174/192

[58] Field of Search ..... 174/179, 169, 174/188, 176, 192, 177, 178

[56] References Cited

U.S. PATENT DOCUMENTS

| | | | |
|---|---|---|---|
| 4,174,464 | 11/1979 | Kawaguchi et al. | 174/212 |
| 4,246,696 | 1/1981 | Bauer et al. | 29/631 |
| 5,023,295 | 6/1991 | Bosch et al. | 524/783 |
| 5,695,841 | 12/1997 | Mazeika et al. | 428/36.92 |

*Primary Examiner*—Kristine Kincaid
*Assistant Examiner*—Mark Olds
*Attorney, Agent, or Firm*—Foley & Lardner

[57] ABSTRACT

An electric high-voltage insulator made from plastic comprises at least one glass fiber rod (1), at least one shield covering (2) made from silicone rubber which surrounds the glass fiber rod (1) and has concentric bulges (3) arranged along the longitudinal axis and bent in the shape of sheds in such a way that they form a convex top side and a concave or flat underside, as well as metal fittings (5) on both insulator ends. In this case, the bulges bent in the shape of sheds have at least one groove (4) on the underside preferably with a minimum depth of 1 mm.

14 Claims, 4 Drawing Sheets

ELECTRIC INSULATOR MADE FROM SILICONE RUBBER FOR HIGH-VOLTAGE APPLICATIONS

BACKGROUND OF THE INVENTION

1. Field of the Invention

The invention relates to an electric high-voltage insulator made from plastic, comprising at least one glass fiber rod, at least one shield covering made from silicone rubber which surrounds the glass fibre rod and has concentric bulges arranged in the direction of the longitudinal axis of the insulator and bent in the shape of sheds in such a way that they form a convex top side and a concave or flat underside, as well as metal fittings at both insulator ends.

2. Description of Related Art

High-voltage insulators for overhead lines have been produced for a long time from ceramic, electrically insulating materials such as porcelain or glass. Alongside this, insulators containing a glass fiber core and a shield covering made from plastic in a composite design are gaining increasingly in importance, because they are distinguished by a series of advantages to which, in addition to a relatively low intrinsic weight, there also counts an improved mechanical resistance to projectiles from fire arms. The shield coverings of such composite insulators are in this case mostly constructed from cycloaliphatic epoxy resins, from polytetrafluoro-ethylene, from ethylene-propylene-diene rubbers or from silicone rubber.

By comparison with composite insulators made from other shield materials, and also by comparison with conventional insulators, composite insulators having a shield covering made from silicone rubber have the advantage that they have excellent insulating properties when used in areas having a highly polluted atmosphere. That is why silicone-rubber insulators are increasingly being used for the purpose of upgrading existing overhead lines having electric insulation problems, which result from atmospheric pollution, by exchanging the conventional insulators for composite insulators having a shield covering made from silicone rubber.

The tracking path required for operating the insulator can be obtained by the number and the diameter of the shields. In the case of very high atmospheric pollution in the area of use of the insulators, the tracking path of the insulators must be longer than in areas of use of low atmospheric pollution. In this case, physical limits, which are defined in the IEC Publication 815, exist for shed overhang and shield spacing. It is not possible for the purpose of obtaining a specific tracking path per insulator length to configure the screens with an arbitrarily large diameter, nor to arrange them arbitrarily close together. Natural limits are thus set here for flat shields.

It has therefore already been proposed to fit shields of plastic composite insulators on their underside with grooves for the purpose of lengthening the tracking path. Such insulators are presented, for example, in EP-A-0 223 777 or in DE-A 11 80 017. The insulators described there have not proved themselves in practice. Grooves on the shield undersides, such as are known from cap-and-pin insulators made from glass or porcelain, tend to fill up with dirt from the atmosphere. The self-cleaning properties of such insulators are poor, since the grooves cannot be washed out by the rain. High surface conductivities in fog are the consequence, with the result that such insulators made from conventional materials tend to electric flashovers, and such as are made from plastics are exposed to the risk of tracking or partial combustion. Consequently, because of the better self-cleaning power, use is made today of conventional and composite insulators having flat shields without grooves on the underside in areas of high atmospheric pollution. These insulators acquire their necessary tracking paths by large shield diameters and a correspondingly long insulator length which is, however, undesired.

SUMMARY OF THE INVENTION

GB-A-2 089 141 describes plastic composite insulators in which the individual prefabricated shields were pushed onto a glass fiber rod, and in which the shields, which can consist of silicone rubber, can be flat on the underside or can be configured with ribs in accordance with the figures. The shield joints are to be bridged electrically by interconnected metal rings or hollow cylinders.

WO 92/10843 teaches cap-and-pin insulators in which at least one shield made from a polymer material, for example polydimethylsiloxane or dimethylsiloxane/methylvinylsiloxane copolymer, is fastened to a porcelain component. The underside of the shields can have ribs. The individual cap-and-pin insulators can be coupled to form insulator chains via metal connecting links.

EP-A-0 033 848 discloses a method for producing a plastic composite insulator, in which the GRP rods are covered with shields in an injection-molding or transfer-molding process, it being possible to use multi-part molds. Silicone rubber is specified inter alia as the material of the shield covering.

It was the object of the present invention to provide a high-voltage insulator which in conjunction with a reduced overall length has a longer tracking path and in so doing fulfils the physical dimensions in accordance with the IEC Publication 815, which can be produced with further reduced cost and has excellent insulation properties when used in a highly polluted atmosphere.

This object is achieved according to the invention by means of an insulator of the generic type mentioned at the beginning and whose characterizing features are to be seen in that the shield covering and the bulges essentially consist of polyvinyldimethylsiloxane plus filler(s) and are cross-linked with perioxide(s), in that the Shore A hardness of the shield covering and of the bulges is at least 40 and in that the bulges bent in the shape of sheds each have at least one groove (4) on the underside.

DETAILED DESCRIPTION OF PREFERRED EMBODIMENTS

Figure 1:
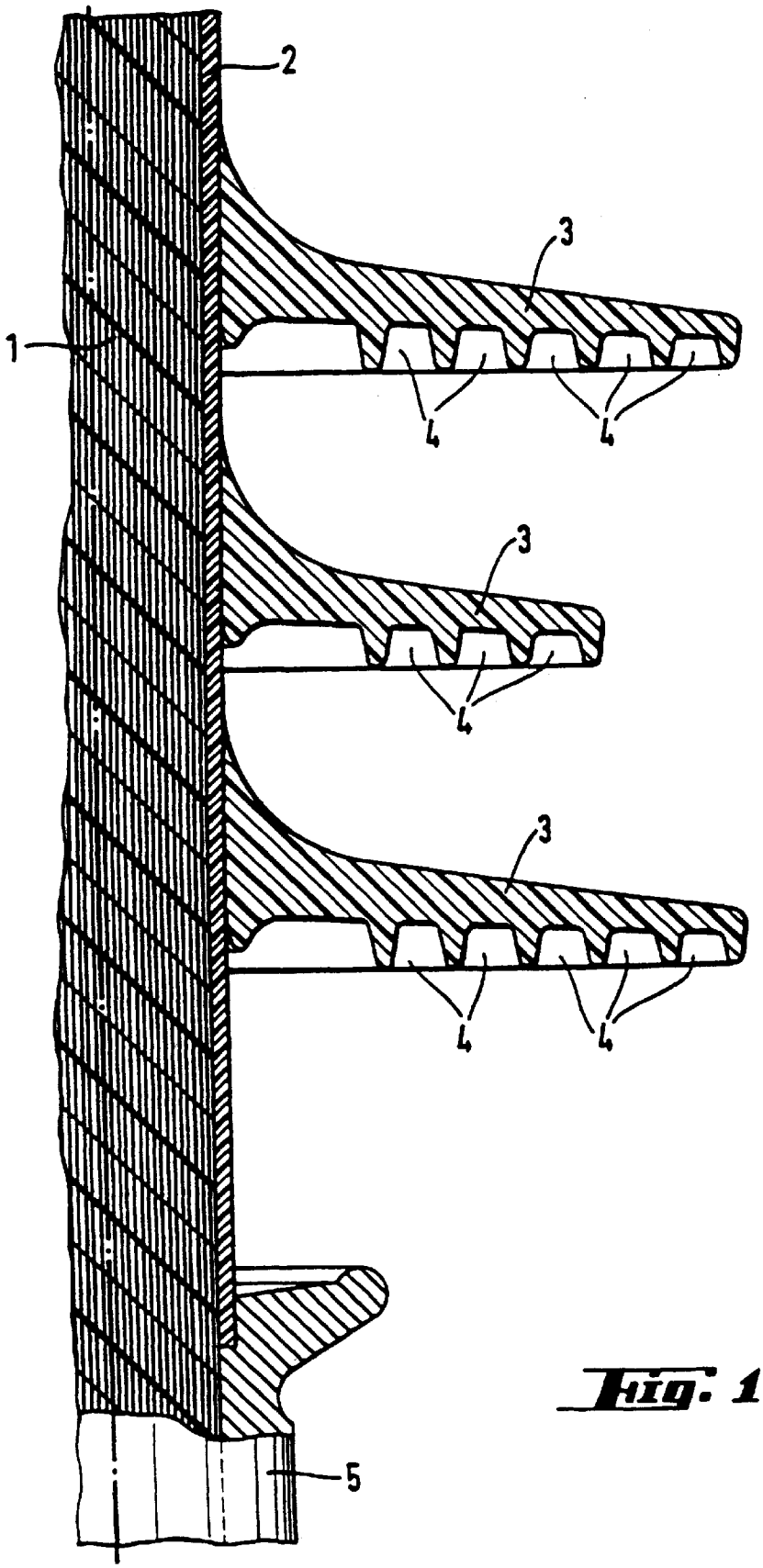
FIG. 1 shows a partial cross section of the insulator according to the present invention.

Contrary to the expectations of the insulator manufacturers and users, it was found, surprisingly, that for composite insulators made from silicone rubber and having a groove on the underside of the shields better insulation properties result than in the case of previously known insulators made from other materials but having a similar geometrical shield design.

It is preferred according to the invention that a plurality of grooves are arranged in the region of the underside of the bulges bent in the shape of sheds. The grooves are intended in this case to have a minimum depth, measured as the distance from the peak to the floor, of at least 1 mm; preferably, their depth is intended to be in the range of 5 to 50 mm. The width of the grooves, measured as the distance between two neighboring peaks, can be in the range of 3 to 200 mm, preferably in the range of 5 to 80 mm. It is preferred, furthermore, that in the region of the grooves and their edges no sharp-edged corners and points occur, but these latter are of rounded design. The protruding webs projecting between the grooves can be perpendicular or steeply inclined. Given a concentric arrangement of neighboring grooves, cylindrical or conical webs are then produced. The grooves or webs preferably extend concentrically about the longitudinal axis, but they can also be guided acentrally.

In an embodiment preferred according to the invention, in accordance with IEC Publication 815 the ratio of $l_4/d$ is to be limited to an upper value of 5: while the variable $l_4$ denotes the real tracking path on the surface of a shield between two points, preferably in cross-section with the inclusion of the longitudinal axis into the cross-sectional surface, d stands for the shortest distance between these points through the air.

Insulators in accordance with the invention can be produced using the method described in DE-A-27 46 870 by producing the shields separately, pushing them in a radially prestressed fashion onto a glass fiber rod coated with silicone rubber, and vulcanizing them together with this silicone rubber layer. The method permits a large degree of freedom in selecting the overall length of the insulators and selecting the desired tracking paths while observing the limits, prescribed in IEC 815, for shed overhang and shield spacing.

As material for the shield covering, in particular for the shields, use is preferably made of silicone rubber whose Shore A hardness is more than 60, such as are supplied by HTC silicone rubber (HTC=hot-temperature-crosslinking), which consist of polyvinyldimethylsiloxanes and fillers and are crosslinked with the aid of peroxides. Other silicone rubbers, as long as they are polyorganodimethylsiloxanes, can also be used. Silicone rubbers which are particularly suitable according to the invention are preferably arranged to be flame-resistant, with the result that the flammability class FVO according to the IEC Publication 707 is reached. This can be achieved by including the filler aluminum oxide hydrate or using a platinum-guanidine complex. Thus, in addition to the improved flame resistance, the high-voltage tracking resistance HK2 and the high-voltage arc resistance HL2 in accordance with DIN VDE 0441 Part 1 (equivalent to ICE 587 Method 1 (1984)(tracking resistance) and ASTM D 495 (1973)(arc resistance)) are also reached, at least. In order to fulfil the high-voltage tracking resistance in HK Class 2, 5 test specimens must withstand a voltage of 3.5 kV over a duration of 6 hours in a multistage test. In order to reach the high-voltage arc resistance in the HL Class 2, it must be possible for 10 test specimens to be successfully exposed to an arc over a burning time of more than 240 sec. The high-voltage insulator according to the invention and made from silicone rubber fulfils the high-voltage diffusion strength according to Class HD2 in accordance with DIN VDE 0441, Part 1.

Care is additionally to be taken when producing the insulators according to the invention that when shaping the shields to be formed with grooves the filling of the mold in which the shields are formed is achieved completely and as far as possible without air inclusions.

The combination according to the invention of shield design and material offers further advantages, as well. Silicone rubber is known to be an expensive material, because the silicone synthesis proceeds from pure silicon. Flat shield designs of insulators made from silicone rubber therefore aim to minimize the use of material, something which leads to thin shields. Thin shields made from silicone rubber, in particular those of relatively large diameter, are therefore mechanically unstable; they tend to deform during storage and transport and can also be easily damaged mechanically. The use of grooves on the shield undersides permits the shields to be kept smaller in diameter in conjunction with an identical or even longer tracking path than flat shields, and in this case the shields gain a substantial degree of mechanical stability owing to the reinforcing effect of the grooves on the shield undersides. The use of material for the grooves is slight and is compensated to a large extent by the tracking path length gained thereby, since lengthening of the tracking path in the case of flat shields can be achieved only via the increase in diameter, which features quadratically in the calculation of material.

The high-voltage insulator of composite design according to the invention is to be explained by way of example with the aid of a plurality of drawings. The drawings and examples refer to the IEC Publication 815, in which rules are contained for designing a high-voltage overhead line insulator, which also cover the design and configuration of the shields:

FIG. 1 shows a partial cross section of the insulator according to the invention. The insulator consists of a glass fiber rod (1) which can consist of glass fibers impregnated with epoxy resin which are arranged in an endless axially parallel fashion in the rod. The glass fiber rod (1) is enveloped by a seamlessly continuous silicone rubber layer (2) which is vulcanized on the surface of the glass fiber rod (1). Arranged on the surface of the silicone rubber layer (2) are shields (3) made from silicone rubber which are fitted on their underside with grooves (4). The shields (3) are prefabricated, pushed onto the silicone rubber layer (2) in a radially prestressed fashion and vulcanized together with said layer. Located at the insulator end is one of the two metal fittings (5) of the insulator for transmitting the tensile force from the glass fiber rod (1) to the insulator suspension (not shown). The metal fitting (5) can consist, for example, of steel, cast iron or other metallic materials and can be connected by radial compression to the end of the glass fiber rod (1). FIG. 1 shows an example of an insulator according to the invention and having alternating shield diameters; it is also possible to use shields of equal diameter or shields having diameters which vary differently in the sequence of shields.

Figure 2:
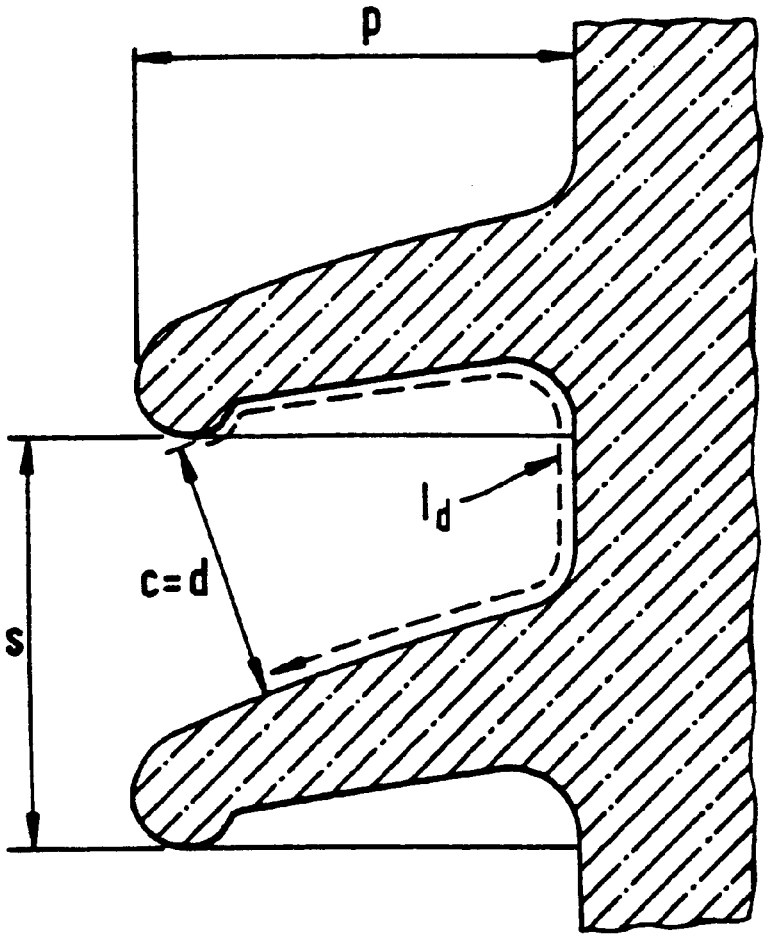
FIG. 2 shows a diagrammatic representation of shields of an overhead line insulator.

FIG. 2 shows a diagrammatic representation of shields of an overhead line insulator. The essential dimensioning criteria are:

shield load p, shield spacing s, associated tracking path $l_d$, and minimum clearance between 2 shields c.

The relationships between these geometrical variables are described in IEC Publication 815, Appendix D, and are:

$c \geqq 30$ mm, $s/p \geqq 0.8$ for shields having grooves in the shield underside, $s/p \geqq 0.65$ for shields having a smooth shield underside, $l_d \leqq 5$.

The tracking path factor CF is the quotient of the total tracking path $l_t$ and the flashover distance $s_t$: $CF = l_t/s_t$23 4.

The profile factor PF takes account of the tracking path 1 which can, for example, be identical with the tracking path $l_d$ $$\frac{2p+s}{l} \geq 0.7.$$

Figure 3B:
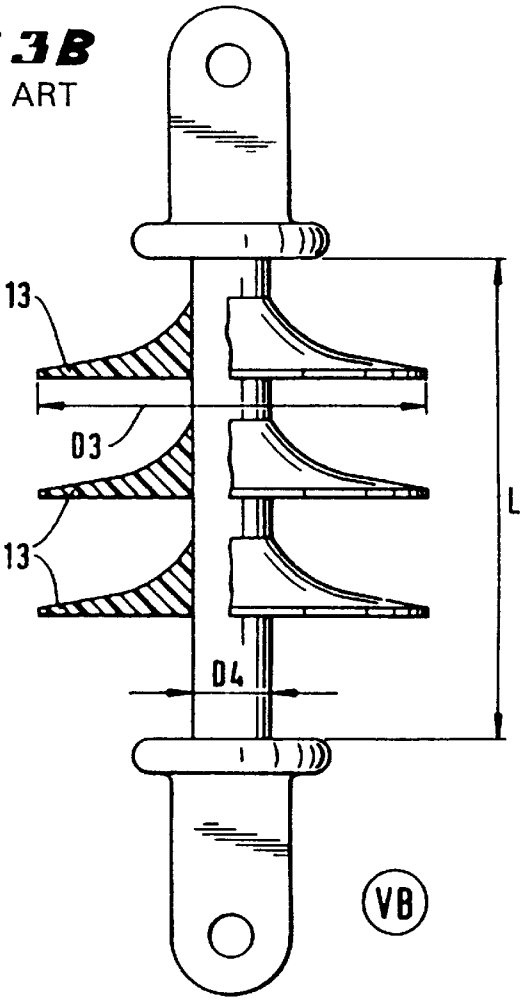
Fig. 3B PRIOR ART
FIG. 3B shows an an insulator produced according to the prior art (VB).
Figure 3A:
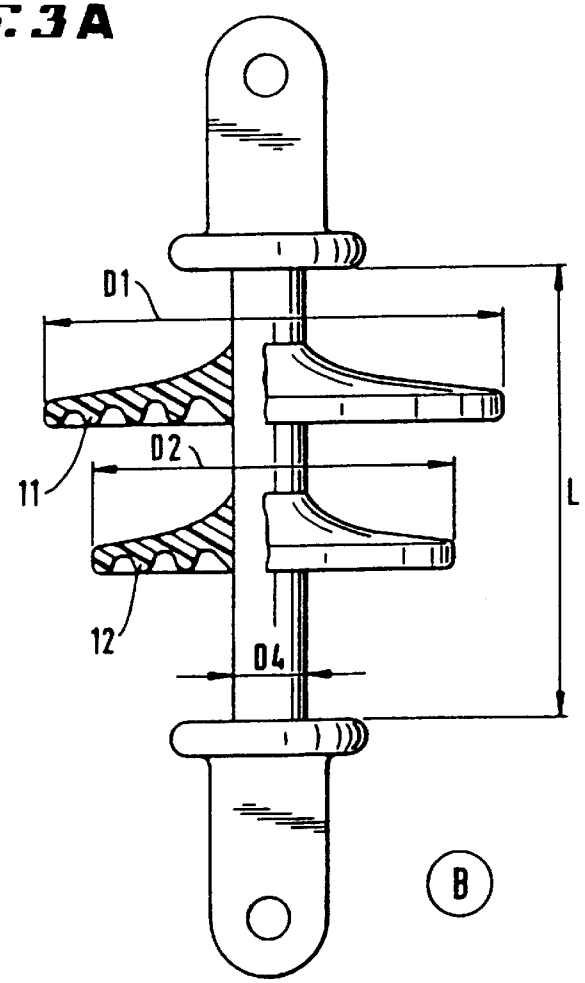
FIG. 3A shows an insulator produced according to the present invention (B).

The insulator B according to the invention is represented in FIG. 3A in comparison with the insulator according to the prior art VB, which are described in more detail in Example 1.

Figure 4:
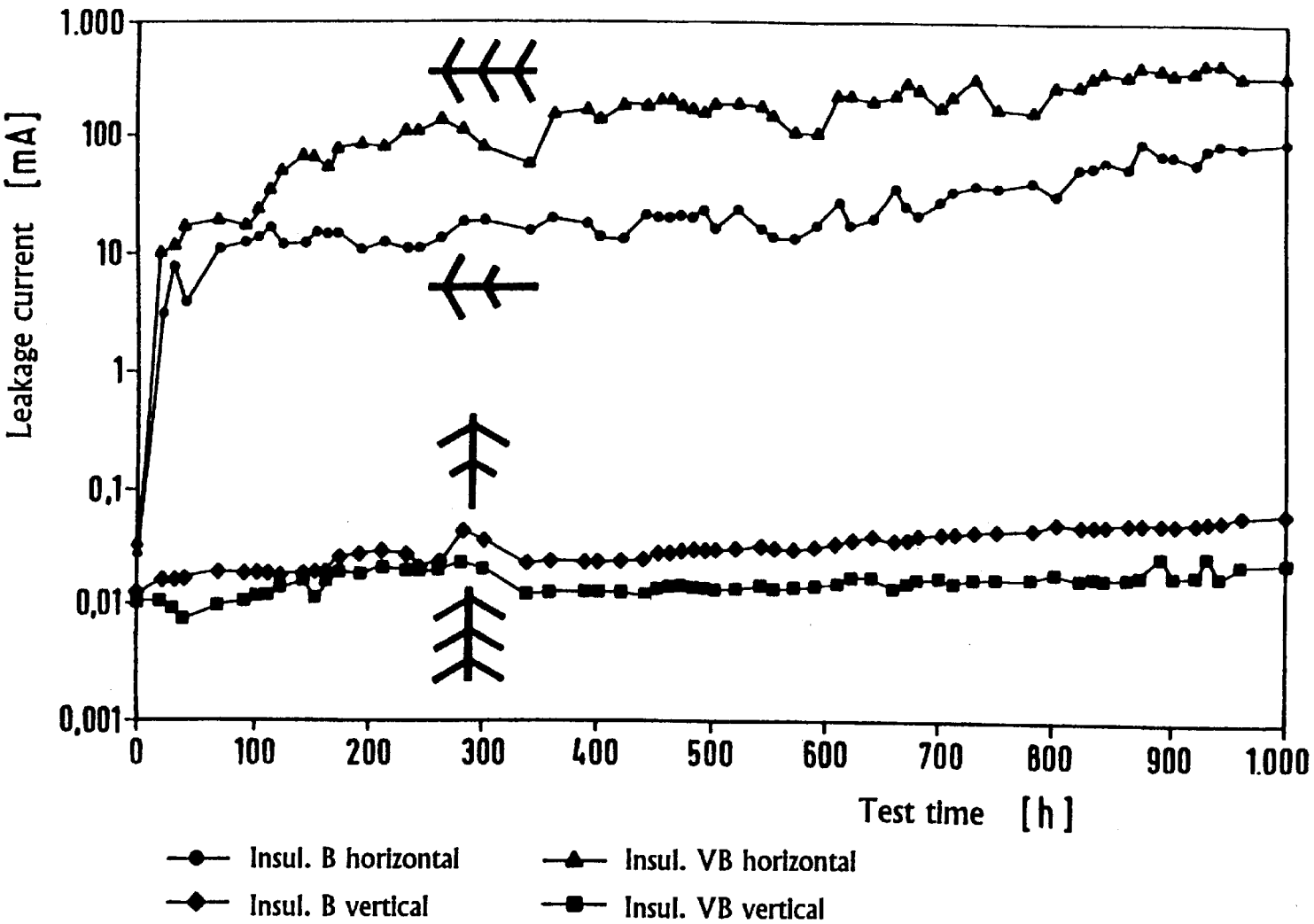
FIG. 4 depicts the results of the leakage current over 1000 hours of test time for insulators VB and B.

FIG. 4 reproduces the result of the leakage current over 1000 hours of test time for the insulators B and VB, described in Example 1, in a vertical mounting position (lower polylines) and in a horizontal mounting position (upper polylines). The signatures characterize the two-shield insulator B and the three-shield insulator VB.

The invention was explained above in more detail with reference to the example of a high-voltage insulator for overhead lines. Of course, it can also be used for high-voltage composite insulators having a shield covering made from silicone rubber which are used as post insulators or as hollow insulators which serve as housings for converters, bushings and the like. The invention can advantageously be applied in cases in which conventional insulators of fixed overall height cause electrical problems with respect to flashovers in areas of atmospheric pollution. It is possible with the aid of the invention to build insulators whose tracking path can be adapted to the atmospheric conditions in conjunction with an unchanged overall height.

EXAMPLES AND COMPARATIVE EXAMPLES

Example 1

Two insulators were produced in each case, as represented in FIGS. 3A and B. The insulators according to the invention were denoted by B1, and the insulators-according to the prior art by VB1. The two insulator types can be regarded as electrically equivalent, because the flashover distances and tracking paths of the two types are the same size. All four insulators were produced according to the method described in DE-A-27 46 870. They consisted of the same shield covering material, specifically a polyvinyldimethylsiloxane with fillers, which was crosslinked with the aid of a peroxide and had a Shore A hardness of 80. The fillers consisted of pyrogenically obtained silicic acid and aluminum oxide hydrate. The arc resistance of this material was more than 240 s (HL 2); the high-voltage tracking resistance was classified as HK 2, as determined according to DIN VDE 0441, Part 1. The flame resistance in accordance with IEC Publication 707 corresponded to Class FVO, and the high-voltage diffusion strength took Class HD2.

(11) and (12) in FIG. 3 denote the heterogeneous shields of the insulator B1 according to the invention which have on their underside grooves of the type described and are represented in detail in FIG. 1. The shields (13) of the insulator VB1 are designed to be flat on their underside. The data of the shields used are summarized in Table 1.

TABLE 1

Characteristics of the shield types used

| Shield type | Tracking path mm | D1 mm | D2 mm | D3 mm | Weight of a shield g |
|---|---|---|---|---|---|
| 11 | 191 | 178 | | | 291 |
| 12 | 125 | | 138 | | 161 |
| 13 | 100 | | | 148 | 154 |

The calculation of the tracking path of the two insulators in FIGS. 3A and B is performed by adding the sum of the tracking paths of the shields per insulator and, in addition, the insulating length L. The dimensions of the insulators and the relationships laid down in accordance with IEC Publication 815 are specified in Table 2.

TABLE 2

Characteristics of insulators VB1 and B1

| Insulator | Tracking path mm | Flash-over distance mm | L mm | D4 mm | Silicone material wt. g | c mm | s mm | p mm | $l_d/c$ | s/p | CF | PF |
|---|---|---|---|---|---|---|---|---|---|---|---|---|
| VB1 | 485 | 210 | 185 | 30 | 533 | 43 | 46 | 59 | 2.7 | 0.78 | 2.3 | 1.4 |
| B1 | 485 | 210 | 175 | 30 | 519 | 49 | 59 | 74 | 4.2 | 0.8 | 2.3 | 1.0 |

Table 2 shows that both types of insulator fulfilled the criteria named in IEC Publication 815 and are also largely identical electrically. The quantity of silicone material used differs only slightly: the insulator B1 according to the invention required 2.6% less silicone material than the insulator VB1.

The four insulators were subjected to an electrical endurance test in a fog chamber. The test is described in more detail in IEC Publication 1109. In this test, one insulator each was arranged horizontally and vertically in the fog chamber. The test voltage was 14 kV. A salt fog having a conductivity of 16 mS/cm was generated artificially. During the test, the leakage currents occurring at the insulators were measured continuously over 1000 hours. This test was passed by all four insulators both in the horizontal and in the vertical positions, because flashovers did not occur during the test, nor did tracks or erosion paths form on the insulators.

FIG. 4 reproduces a diagram with the temporal variation in the leakage currents of the insulators during the test. The diagram shows a fundamental difference in the insulating performance between vertical and horizontal mounting positions. In the vertical mounting position, the two types of insulator showed approximately the same performance: the mean leakage currents were 0.03 mA for the insulator B1 according to the invention, and 0.015 mA for the insulator VB1 according to the prior art.

Behavior was different in the case of the measurements on horizontally mounted insulators. Here, the insulator B1 according to the invention showed a mean leakage current of 20 mA, while the insulator VB1 according to the prior art had a leakage current of approximately 200 mA as mean value which was approximately ten times higher. The effect of the grooves according to the invention was to be seen in this test in the horizontal arrangement of the insulators. This test result was surprising, because a poorer insulating performance than in the case of insulators without grooved shields is known from insulators having grooved shields made from other materials.

Example 2

The tracking path of insulators is adapted to the later location of use. Instances of high atmospheric pollution require long tracking paths. For this example, insulators were produced for a 110 kV overhead line having a tracking path of 3350 mm. The overall length of the insulator, and thus also the fixed insulating length L were prescribed. Table 3 sets forth the characteristics of the insulator VB2 according to the prior art and of the insulator B2 according to the invention.

TABLE 3

Characteristics of insulators VB2 and B2

| Insulator | Tracking path mm | Flash-over distance mm | Shield type | No. of shields | L mm | D4 mm | Silicone material weight g | c mm | J mm | p | $l_d/c$ | s/p | CF | PF |
|---|---|---|---|---|---|---|---|---|---|---|---|---|---|---|
| VB2 | 3375 | 1000 | 3 | 24 | 975 | 30 | 4068 | 36 | 39 | 59 | 3.0 | 0.66 | 3.4 | 1.4 |
| B2 | 3350 | 1000 | 2 | 19 | 975 | 30 | 3350 | 39 | 49 | 54 | 3.7 | 0.91 | 3.4 | 1.2 |

The flashover distance corresponds to the length of a fiber tensioned over the insulator, in the case of a vertically positioned insulator the measurement being carried out from the lower edge of the upper fitting on the outside over the shields up to the upper edge of the lower fitting.

The shield type 2 in accordance with Table 1 was selected for the insulator B2 according to the invention. The insulator VB2 was fitted, as in Example 1, with shield type 3. Table 3 shows that both insulators fulfilled the criteria named in IEC publication 815. From the electrical standpoint, the two insulators are to be regarded as equivalent, since the flashover distance and also the total tracking path are approximately the same size. However, for the insulator B2 according to the invention the cost of production is clearly lower than for the insulator VB2 according to the prior art. Only 19 shields are required instead of 24, and the quantity of silicone material is 15.6% less for the shield covering of the insulator B2 according to the invention than for the insulator VB2.

Example 3

In the case of a particularly high degree of atmospheric pollution, such as are to be encountered, for example, in coastal zones having neighboring deserts, extreme tracking paths are also required. For Example 3, insulators were produced for a 110 kV line having a tracking path of 4050 mm. Use was made of insulators VB3 according to the prior art and insulators B3 according to the invention.

TABLE 4

Characteristics of insulators VB3 and B3

| Insulator | Tracking path mm | Flash-over distance mm | Shield type | No. of shields | L mm | D4 mm | Silicone material weight g | c mm | s mm | p mm | $l_d/c$ | s/p | CF | PF |
|---|---|---|---|---|---|---|---|---|---|---|---|---|---|---|
| VB3 | 4070 | 1200 | 3 | 29 | 1170 | 30 | 5035 | 36 | 39 | 59 | 3.0 | 0.66 | 3.4 | 1.4 |
| B3 | 4031 | 1030 | 1 | 16 | 975 | 30 | 5028 | 49 | 59 | 74 | 4.5 | 0.8 | 3.9 | 0.9 |

The shield type 1 in accordance with Table 1 was selected for the insulators B3 according to the invention. The comparison insulators VB3 were fitted, as in the case of Examples 1 and 2, with the shield type 3. Both insulators fulfilled the criteria named in IEC Publication 815. On the basis of these criteria, however, it was necessary for the comparison insulator VB3 to be designed longer than is otherwise customary for 110 kV insulators. However, it was possible for the insulator B3 according to the invention to be kept to the conventional length. It was 17% shorter than the insulator VB3. Although it required the same quantity of silicone material as the comparison insulator VB3, the number of the shields could, however, be reduced from 29 to 16, that is to say by 45%. This signifies a clear advantage with respect to the production costs for the shields.

Example 4

The advantages of the insulators according to the invention took effect at best in the case of instances of high atmospheric pollution and high electrical transmission voltages. In zones of high pollution in desert areas near the coast, specific tracking paths of 50 mm/kV are required for conventional insulators made from porcelain and glass. By using composite insulators having a shield covering according to the invention and made from silicone elastomers of the type described here, it was possible to lower the specific tracking path to 40 mm/kV. In the case of a transmission voltage $U_{max}$ of 420 kV, an insulator tracking path of 16800 mm was thus required for composite insulators of the type described.

It was possible for this tracking path to be realized in different ways. In accordance with the prior art, shields having a smooth underside and of identical or alternating diameter can be used. According to the invention, again, insulators having both screens of the same diameter and having alternating screen diameters are possible. In this example, two types of insulator according to the prior art and having alternating or uniform shield diameters were contrasted with three types of insulator according to the invention. For a tracking path of 16800 mm and an insulator core diameter of d=30 mm:

VB4 Denotes an insulator according to the prior art and having alternating shield diameters of 168 and 134 mm, in turn, VB5 denotes an insulator according to the prior art and having uniform shield diameters of 148 mm, B4 denotes an insulator according to the invention and having alternating shield diameters (see also FIG. 1) of 178 and 138 mm, B5 denotes an insulator according to the invention and having uniform shield diameters of 178 mm, and B6 denotes an insulator according to the invention and having uniform shield diameters of 138 mm.

Observing the rules described in IEC Publication 815, different limiting variables for dimensioning were produced for the various insulators. The dimensions of insulators VB4, B4 and B5 were prescribed by the tracking path factor CF which was to be observed for these insulators having the maximum value 4, resulting in an insulating length L of 4200 mm for these insulators. The dimensions of the insulator VB5 were predetermined by the ratio of the shield spacing to the shed overhang (s/p). The insulator B3 was fixed by $l_d/C$.

Table 5 reproduces the dimensions resulting from these limiting conditions. In the case of alternating shield diameters, it was also necessary to take account of the shed overhang conditions $p_1$ and $p_2$ ($p_1-p_2 \leqq 15$ mm). The shed overhang p is represented in accordance with IEC 815 in FIG. 2.

reduced, specifically by 35% and 46%, respectively, in the case of the alternatives B4 and B5.

Insulators for this intended use have a substantial inherent weight. The effect of this in the case of insulators according to the prior art was that when the insulators were laid horizontally on a plane surface, it was possible for the shields to be permanently deformed by the inherent weight. This occurred, in particular, in the case of alternating shield diameters, as in the case of insulator VB4, in the case of which the insulator weight of the 62 shields of large diameter had to be borne. By contrast, the insulators B4 and B5 had mechanically stable shields which suffered no deformation during transportation of the insulators.

We claim:

1. An electric high-voltage insulator made from plastic, comprising at least one glass fiber rod (1), at least one shield covering (2) made from silicone rubber which surrounds the glass fiber rod and has concentric bulges (3) arranged in the direction of the longitudinal axis of the insulator and bent in the shape of sheds in such a way that they form a convex top side and a concave or flat underside, as well as metal fittings (5) at both insulator ends, wherein the shield covering and the bulges essentially consist of polyvinyldimethylsiloxane plus filler(s) and are cross-linked with peroxide(s), wherein the Shore A hardness of the shield covering and of the bulges is at least 40 and wherein the bulges bent in the shape of sheds each have at least one groove (4) on the underside.

2. The electric high-voltage insulator as claimed in claim 1, wherein a plurality of grooves (4), are arranged in a region a the undersides of the bulges (3) bent in the shape of sheds.

3. The electric high-voltage insulator as claimed in claim 1, wherein the groove(s) has/have a minimum depth, measured as the distance from a peak of the groove floor, of at least 1 mm.

4. The electric high-voltage insulator as claimed in claim 3, wherein the groove(s) has/have a depth in the range of 5 to 50 mm.

5. The electric high-voltage insulator as claimed in claim 1, wherein the width of the groove(s), measured as the distance between two neighboring peaks, is in the range of 3 to 200 mm.

6. The electric high-voltage insulator as claimed in claim 5, wherein the width of the groove(s) is in the range of 5 to 80 mm.

TABLE 5

Characteristics of insulators of Example 4

| Insulator | Flash-over distance mm | Shield diameter $D_1$ mm | Shield diameter $D_2$ mm | $p_1$-$p_2$ mm | $l_d/c$ | s mm | p mm | s/p | No. of shields | Shield weight $D_1$ g | Shield weight $D_2$ g | Silicone material weight kg |
|---|---|---|---|---|---|---|---|---|---|---|---|---|
| VB4 | 4200 | 168 | 134 | 17 | 4.1 | 70 | 69 | 1.01 | 123 | 202 | 123 | 21.7 |
| VB5 | 4680 | 148 | — | — | 4.1 | 39 | 59 | 0.66 | 121 | 154 | — | 20.4 |
| B4 | 4200 | 178 | 138 | 20 | 4.4 | 105 | 74 | 1.42 | 80 | 291 | 161 | 19.7 |
| B5 | 4200 | 178 | — | — | 4.7 | 65 | 74 | 0.88 | 66 | 291 | — | 20.8 |
| B6 | 4400 | 138 | — | — | 5.0 | 44 | 54 | 0.81 | 100 | 161 | — | 17.8 |

Table 5 shows that the insulators VB5 and B6 produce longer insulators than the others, and are therefore not to be preferred. The economic solution for an insulator according to the prior art was the insulator VB4 with alternating shield diameters. By contrast, the two alternatives B4 and B5 according to the invention offered the advantage of a saving in material. The number of the shields was substantially

7. The electric high-voltage insulator as claimed in claim 1, wherein the groove(s) and edges of the groove(s) are of rounded design.

8. The electric high-voltage insulator as claimed in of claims 1, wherein material for the shield covering (2), and for the bulges (3) bent in the shape of sheds, is silicone rubber whose Shore A hardness is at least 60.

9. The electric high-voltage insulator as claimed in claim 8, wherein the shield covering contains inorganic fillers.

10. The electric high-voltage insulator as claimed in claim 9, wherein the inorganic fillers comprise pyrogenic silicic acid.

11. The electric high-voltage insulator as claimed in claim 1, wherein the shield covering contains aluminum oxide hydrate or a platinum-guanidine complex.

12. The electric high-voltage insulator as claimed in claim 1, wherein the insulator can be successfully exposed to a high-voltage arc resistance test over a burning time of more than 240 s in accordance with ASTM D 495 (1973).

13. The electric high-voltage insulator as claimed in claim 12, wherein the insulator can be successfully exposed to a high-voltage tracking-resistance test with a test voltage of at least 3.5 kV over a period of 6 hours in accordance with IEC 587 Method 1 (1984).

14. The electric high-voltage insulator as claimed in claim 1, wherein the Shore A hardness is at least 60.

* * * * *